US007144222B2

(12) United States Patent
Lanni et al.

(10) Patent No.: US 7,144,222 B2
(45) Date of Patent: Dec. 5, 2006

(54) PROPELLER

(75) Inventors: Francesco Lanni, Walpole, MA (US); John A. Eckhart, Norton, MA (US)

(73) Assignee: Rolls-Royce Naval Marine, Inc., Walpole, MA (US)

( * ) Notice: Subject to any disclaimer, the term of this patent is extended or adjusted under 35 U.S.C. 154(b) by 127 days.

(21) Appl. No.: 10/425,035

(22) Filed: Apr. 29, 2003

(65) Prior Publication Data

US 2004/0005221 A1 Jan. 8, 2004

Related U.S. Application Data

(60) Provisional application No. 60/375,713, filed on Apr. 29, 2002.

(51) Int. Cl.
*B64C 11/24* (2006.01)
*F01D 5/14* (2006.01)

(52) U.S. Cl. ..... 416/227 A; 416/233

(58) Field of Classification Search ..... 416/144, 416/145, 227 R, 227 A, 232, 233
See application file for complete search history.

(56) References Cited

U.S. PATENT DOCUMENTS 4,643,647 A 2/1987 Perry
4,664,600 A 5/1987 Perry
5,269,658 A 12/1993 Carlson et al.
5,634,771 A * 6/1997 Howard et al. ..... 416/241 A
6,033,186 A 3/2000 Schilling et al.
6,311,924 B1 * 11/2001 Ferrer ..... 244/17.13

FOREIGN PATENT DOCUMENTS

| | | |
|---|---|---|
| GB | 792258 | 3/1958 |
| GB | 2154286 | 9/1985 |
| WO | 9955476 | 11/1999 |

OTHER PUBLICATIONS

International Search Report Aug. 14, 2003.

* cited by examiner

*Primary Examiner*—Edward K. Look
*Assistant Examiner*—Richard A. Edgar
(74) *Attorney, Agent, or Firm*—Timothy L. Klima

(57) ABSTRACT

A propeller or propeller blade is manufactured using lattice block material to provide a structure which is generally hollow but for a three-dimensional lattice of support spars. The propeller or propeller blade, being predominately hollow, is substantially lighter than a solid cast propeller or propeller blade while retaining the desired strength due to the three-dimensional lattice of support spars.

30 Claims, 6 Drawing Sheets

PROPELLER

This application claims priority to U.S. patent application Ser. No. 60/375,713 filed Apr. 29, 2002, the entirety of which is incorporated by reference herein.

BACKGROUND OF THE INVENTION

The present invention relates to a propeller and method for manufacturing same, and more particularly, to a propeller manufactured using a lattice block material.

Propellers for ships are quite large, often spanning over 10 feet in diameter and are typically made of a bronze alloy. The propellers can be manufactured as a single casting or can be designed to have a plurality of blades cast separately that are then attached to a separate central hub, with the respective components being generally solid castings. The combination of size and material makes the propeller quite heavy and places great mechanical stresses on the blade attachment components, main shaft and main shaft bearings that must support the weight. The propeller can even be limited to a smaller diameter than desired for an application because the weight of a larger propeller imparts excessive stresses on such components. Large propellers solid cast propellers and propeller blades can also have material cross-section dimensions that are so large that the solidification of the material results in non-optimal through-section microstructure and reduced mechanical strength properties, such as tensile strength, yield strength, elongation and fatigue life.

In an attempt to address such shortcomings, and in particular, to reduce the weight of the propeller, the thickness of the blades has been reduced with respect to the chord length of the blades. This, however, can result in compromised cavitation performance and reduced mechanical strength properties of the propeller.

In addition, prior propellers have generally fixed modal/vibrational characteristics due to the material mass and properties of the propeller blades. Although such propellers can be balanced by the addition or removal of material to one or more of the blades, there are limitations to the manner such balancing can be performed while preserving the performance and structural integrity of the propeller.

A type of casting technology has been developed by the Jonathan Aerospace Materials Corporation of Wilmington, Mass. that creates a cast object having a continuous three-dimensional lattice of support spars with spaces between the spars being hollow, occasionally referred to as lattice block material or LBM. Such technology is disclosed, for instance, in International Patent Publication No. WO 99/55476, entitled "Method and Device for Casting Three-Dimensional Structured Objects", published Nov. 4, 1999, the contents of which are incorporated by reference herein. To provide the device and method for casting three-dimensional structured objects which are economical and allow for the objects to be produced to be cast in a form in which they can easily be reused or produced, the invention provides for the device to comprise several cores (1; 31, 32) which each have essentially the form of a prism and at least three walls which are parallel to an axis or slightly convergent. The cores are constructed of known casting sand compositions. The prism shapes and cross-sections are chosen such that several cores (1; 31, 32) can be juxtaposed by their prism surfaces (2, 3, 4) in a substantially tight and space-filling manner. At least part of the prism surfaces (2, 3, 4) presents recesses or casting channels (6, 7, 8, 9) which form a continuous structure when the cores (1; 31, 32) are assembled. As regards the method, the hollow form is composed of several cores with a prism-shaped cross-section in such a way that the prism surfaces lie against each other in a substantially compact and flush manner and the cores substantially fully fill out the casting space provided for, with recesses in the prism surfaces defining the structure to be cast (the spars).

SUMMARY OF THE INVENTION

The present invention is a propeller or propeller blade manufactured using lattice block material to provide a structure which is generally hollow but for the three-dimensional lattice of support spars. The propeller or propeller blade, being predominately hollow, is substantially lighter than a solid cast propeller or propeller blade while retaining the desired strength due to the three-dimensional lattice of support spars.

It is an object of the present invention to provide a cast propeller, propeller blade or other component that is substantially hollow and weighs substantially less than a corresponding solid component, but which retains a desired strength due to the internal reinforcing of the LBM lattice.

It is a further object of the present invention to provide a lighter propeller that reduces the stresses imparted on the blade attachment components, main shaft and main shaft bearings that must support the weight of the propeller.

It is a further object of the present invention to provide a propeller that can be increased in size for better performance without exerting excessive forces on the blade attachment components, main shaft and main shaft bearings. Alternatively, the size and mechanical properties of the blade attachment components, main shaft and main shaft bearings can be reduced since they are exposed to lower forces due to weight of the propeller, thereby reducing the weight of the propulsion system as a whole.

It is a further object of the present invention to reduce compromises in the shape and configuration of the propeller due to the weight of the propeller.

It is a further object of the present invention to provide a propeller that can be tuned with respect to modal/vibrational characteristics, as compared to solid propellers, by the addition of fill materials to the generally hollow interior of the blade It is a further object of the present invention to provide a propeller that can be tuned by varying lattice support spar density, alignment and/or configuration, either uniformly or nonuniformly within the propeller.

It is a further object of the present invention to determine a desired lattice spar density, configuration and alignment within the propeller, whether uniform of not, by a selected analysis method, input such information into a CAD/CAM system to create a plurality of molds for creating a plurality of individual casting cores that when assembled together, will provide a casting core block that will produce a lattice structure having the desired specific spar density, configuration and alignment.

Further objects and characteristics of the invention can be found in the detailed description below taken in conjunction with the attached Figures, wherein like reference numerals denote like components.

DETAILED DESCRIPTION OF THE INVENTION

Figure 1A:
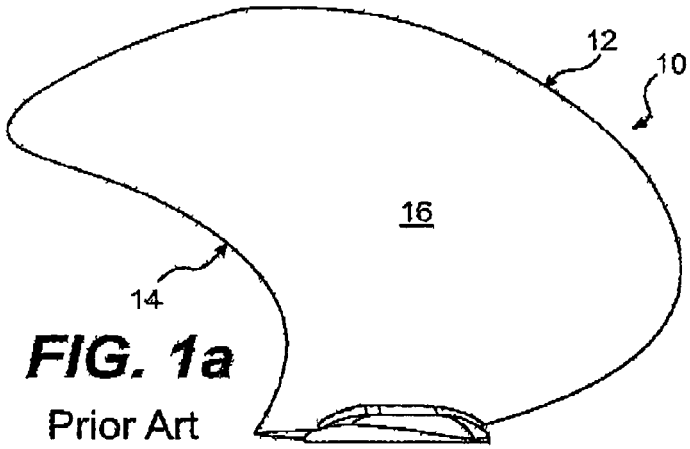
FIG. 1a Prior Art
FIGS. 1*a–e* (Prior Art) show five views of a known propeller blade constructed for attachment to a central propeller hub.
Figure 1B:
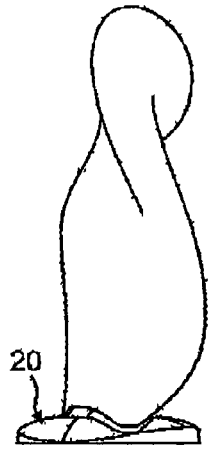
FIG. 1b Prior Art
Figure 1C:
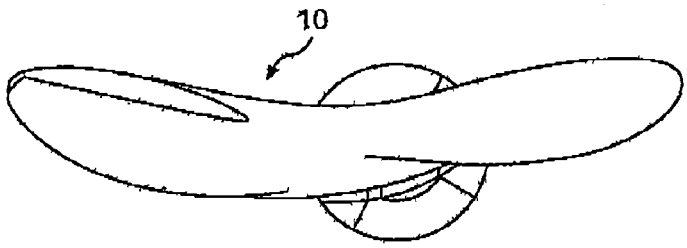
FIG. 1c Prior Art
Figure 1D:
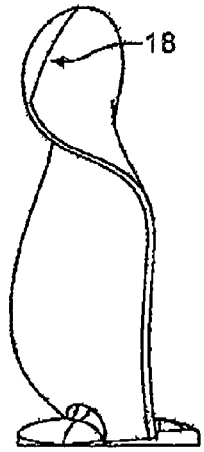
FIG. 1d Prior Art
Figure 1E:
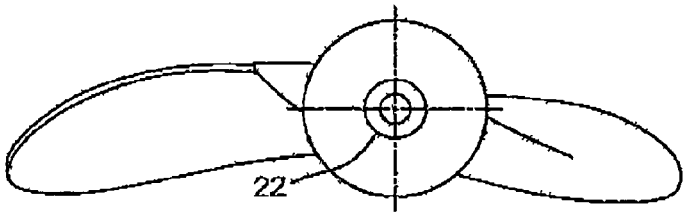
FIG. 1e Prior Art

FIGS. 1*a–e* (Prior Art) show five views of a known propeller blade 10 constructed for attachment to a central propeller hub in a known manner. The blade 10 includes a leading edge 12, a trailing edge 14, a blade surface 16, a tip 18, a flange 20 for mounting to a central propeller hub and a balance pocket 22 where material can be added or removed to alter the weight of the blade 10 and thus, the balance of the propeller. For purposes of this description, the term propeller is used whether it is in a driving mode, as with a propeller for a ship or airplane, or a driven mode, as with a turbine or windmill.

Figure 2A:
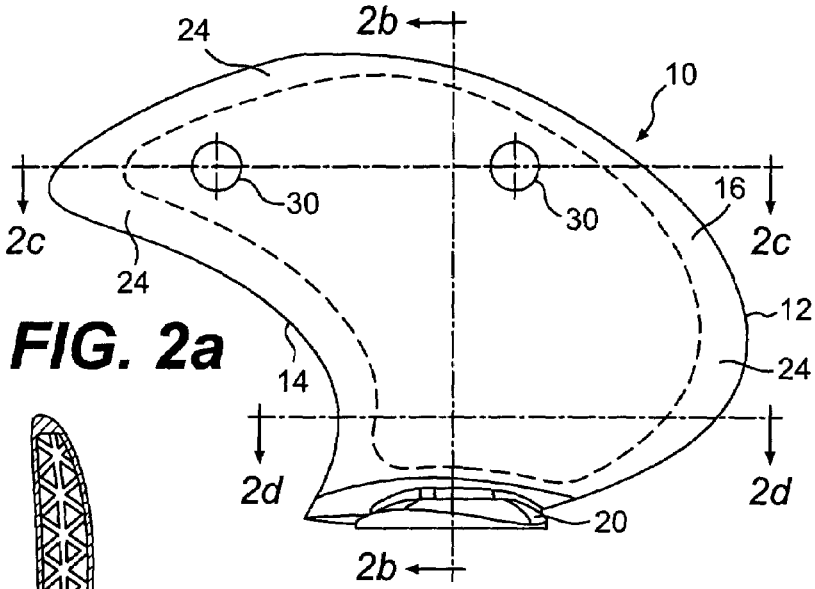
FIGS. 2*a–f* show six views of a propeller blade according to a first embodiment of the present invention.
Figure 2B:
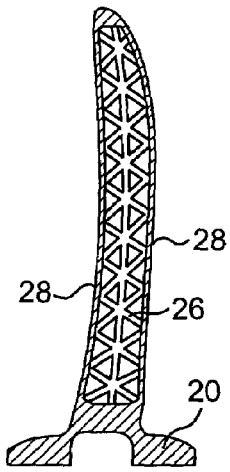
Figure 2C:
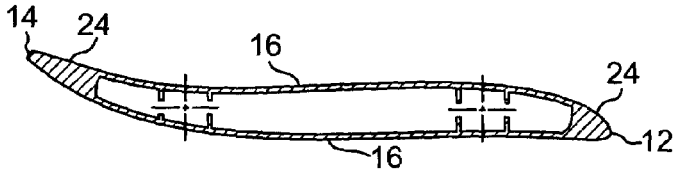
Figure 2D:
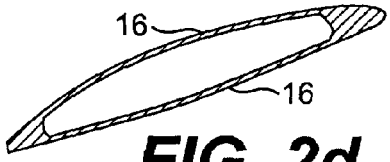
Figure 2E:
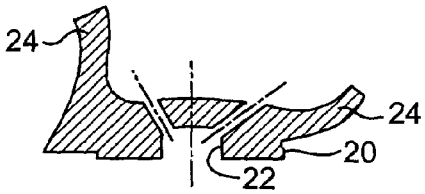
Figure 2F:
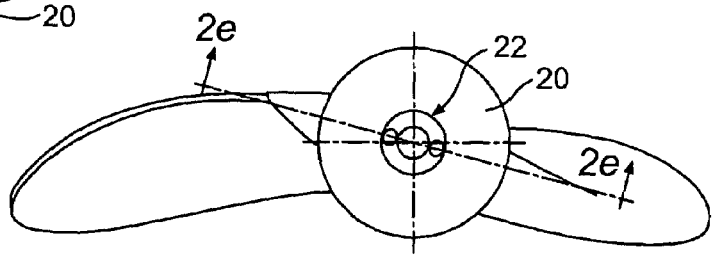
Figure 3A:
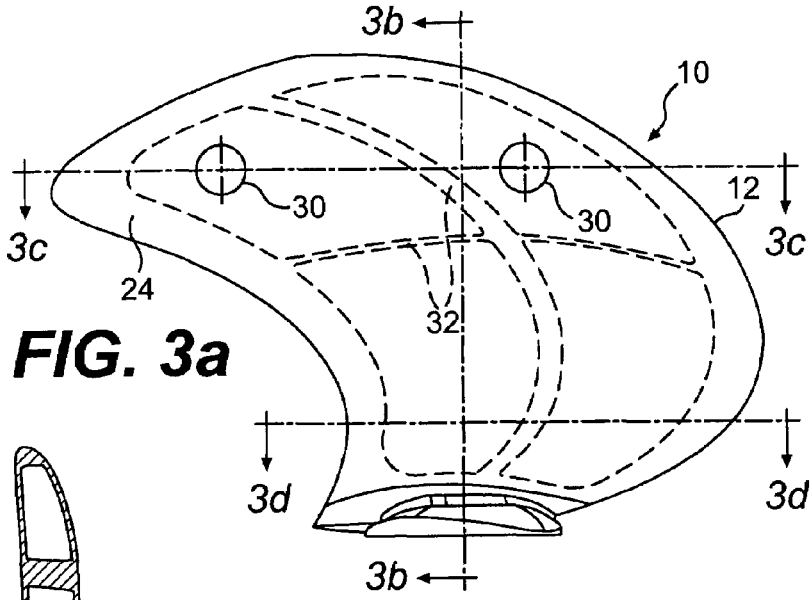
FIGS. 3*a–f* show six views of a propeller blade according to a second embodiment of the present invention.
Figure 3B:
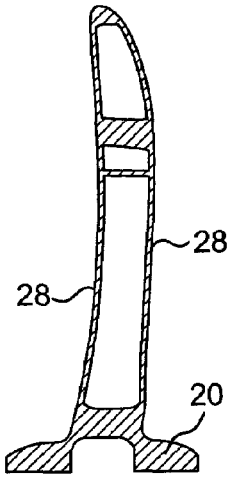
Figure 3C:
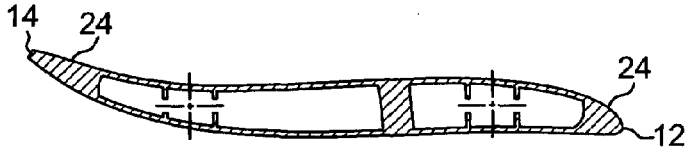
Figure 3D:
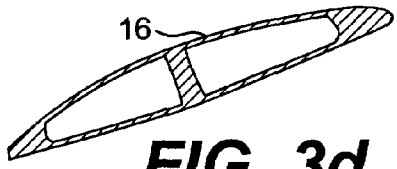
Figure 3E:
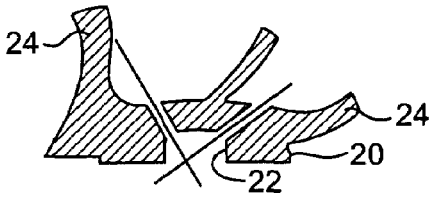
Figure 3F:
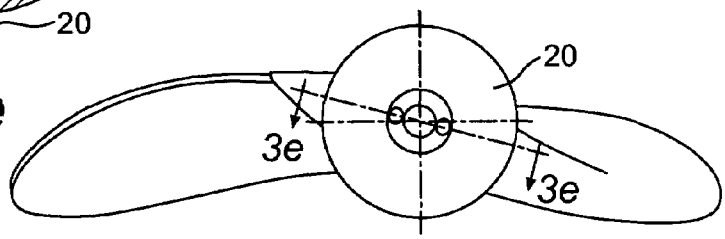
Figure 4A:
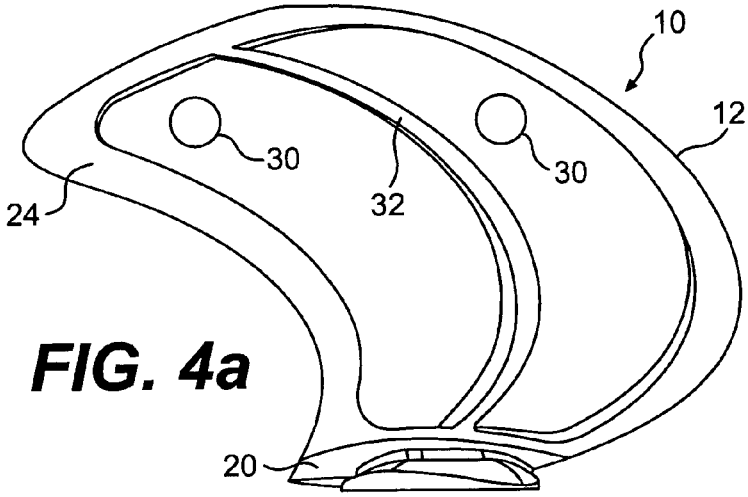
FIGS. 4*a–e* show five views of a propeller blade according to a third embodiment of the present invention.
Figure 4B:
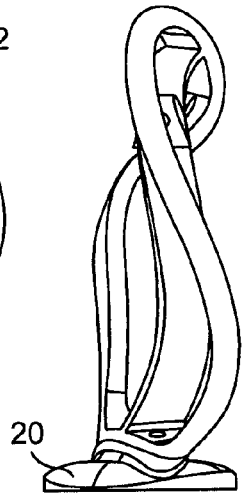
Figure 4C:
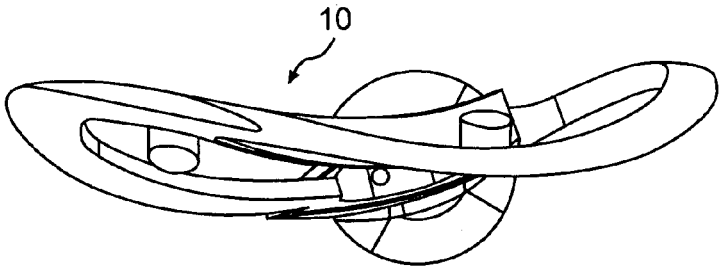
Figure 4D:
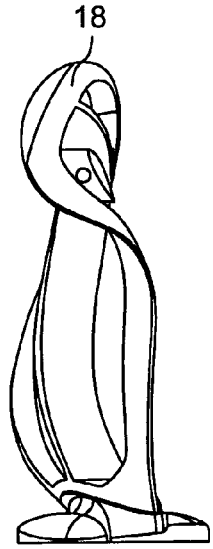
Figure 4E:
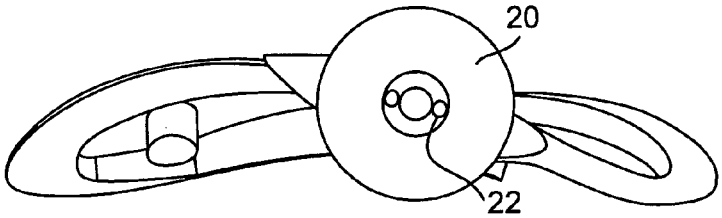

FIGS. 2*a–f* show six views of a propeller blade 10 according to a first embodiment of the present invention. The blade 10 can have the same general configuration as the blade shown in FIG. 1 or can have a different configuration, as desired. The blade 10 includes a periphery 24 that is cast in a generally solid manner, integral with the flange 20. Within this periphery, the blade 10 is cast from an internal LBM lattice 26 of interconnected support spars and interstitial hollow spaces forming a support structure, shown only in FIG. 2*b*, but which is understood to fill space internal of the periphery 24 in the other Figures as well. FIG. 2*b*shows that the blade 10 includes a solid surface skin 28 connected to and covering the LBM lattice 26. In the preferred embodiment, the entire blade 10 of FIGS. 2*a–f*, and all components thereof, is cast as a single integral component, but which is substantially hollow because of the LBM lattice 26.

The blade 10 is manufactured as follows. A blade casting mold is constructed that has the desired external configuration and dimensions for the blade 10. An existing mold for manufacturing a solid cast blade can be used if of the desired configuration and dimensions. A block is built up of by stacking the prism shaped casting cores in a compact, contiguous and flush manner until a casting core block has constructed that has the desired overall dimensions for the LBM lattice that is desired within the blade 10. The casting core block at this point will generally be in the form of a rectangular block. The casting core block can then be carved with known cutting tools until it has the configuration and dimensions to produce an LBM lattice 26 of the desired configuration and dimensions.

To produce the blade 10 shown in FIGS. 2*a–f*, the casting core block would be carved so that it could be positioned in the blade casting mold with a clearance between the exterior of the carved casting core block and an interior of the blade casting mold. Once positioned in the blade casting mold as desired, the carved casting core block would be pinned or fixed to the blade casting mold to maintain the desired alignment between the two components. Since the clearance between the two components is substantially open, it will be filled solid with material upon casting of the blade, thereby producing the surface skin 28, periphery 24 and flange 20 of the blade 10. However, the casting material can only enter the casting channels in the casting core block and is precluded from filling the volume occupied by the casting core material.

Once the blade casting has sufficiently cooled, the rough blade casting can be removed from the blade casting mold. Then, the casting core block can be disintegrated using mechanical tools, pressurized air, vibration, etc. and the disintegrated material removed through balance pocket 22 and sand removal pockets 30 in the surface skin 28. Thus, the LBM lattice 26 is integrally cast with the surface skin 28, periphery 24 and flange 20 with the volumes previously occupied during casting by the casting core material now being hollow.

FIGS. 3*a–f* show six views of an alternative embodiment of the blade 10. This blade embodiment is similar to the embodiment shown in FIGS. 2*a–f* but includes longitudinal and transverse reinforcing spars 32 that are generally solid to add strength to the blade 10. These reinforcing spars 32 are created by leaving this space open when carving and positioning the casting core block in the blade casting mold. This may be done most efficiently by using not just one overall casting core block, but a plurality of smaller casting core blocks positioned and fixed in a desired relation with respect to one another to form free spaces therebetween that will be filled wit casting material to become the reinforcing spats 32. The reinforcing spars can alternatively be connected to each other, to the periphery, to the lattice and/or to the flange, as desired. The LBM lattice 26 is not shown in FIGS. 3*a–f* but it is understood that it would be present in the open areas shown, as in FIG. 2*b*.

FIGS. 4*a–e* show an alternative embodiment similar to the embodiment in FIGS. 3*a*-3*f* but where the blade 10 includes only a central longitudinal reinforcing spar 32. In this embodiment, the blade 10 may not be provided with an overall cast surface skin 28. Rather, the LBM lattice 26 may be exposed within the periphery 24, with a surface skin being provided by adding a relatively low weight resin material to the hollow volume of the LBM lattice and molding an exposed surface of the resin material in a desired surface configuration. In such a configuration, the reinforcing spars give additional strength to the surface resin. Alternatively, a surface skin can be welded or otherwise attached over the exposed lattice.

Figure 5:
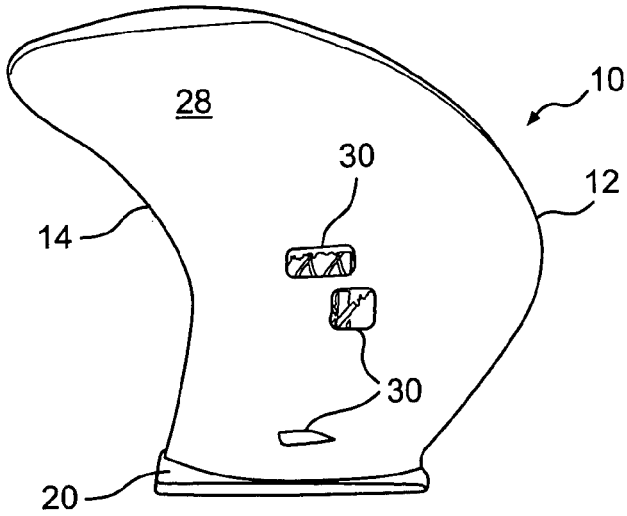
FIG. 5 shows a prototype blade manufactured according to the present invention.
Figure 6:
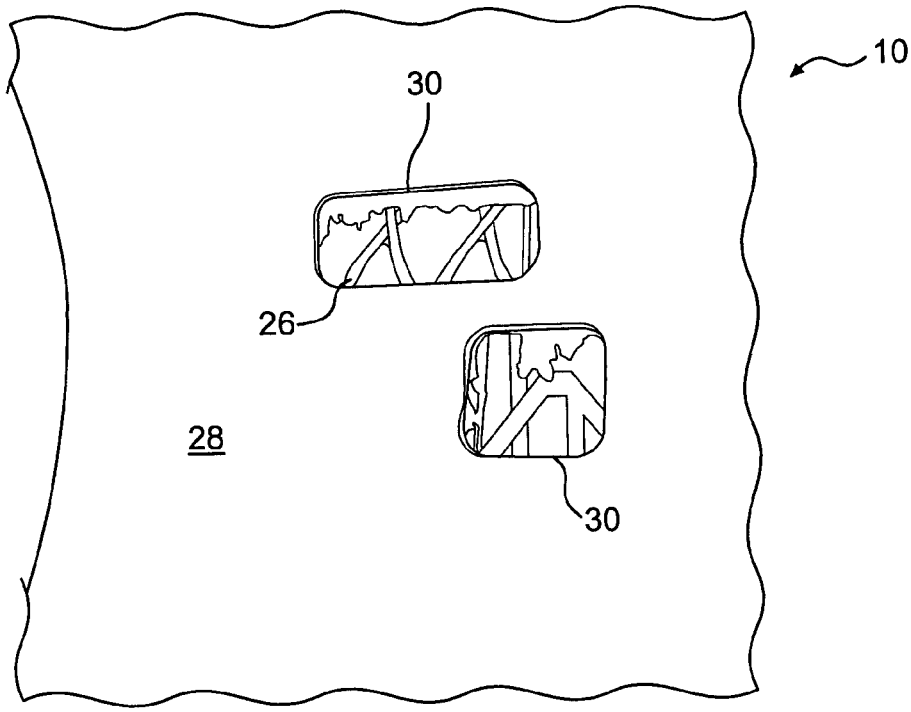
FIGS. 6–8 show enlarged detail views of the prototype blade of FIG. 5.
Figure 7:
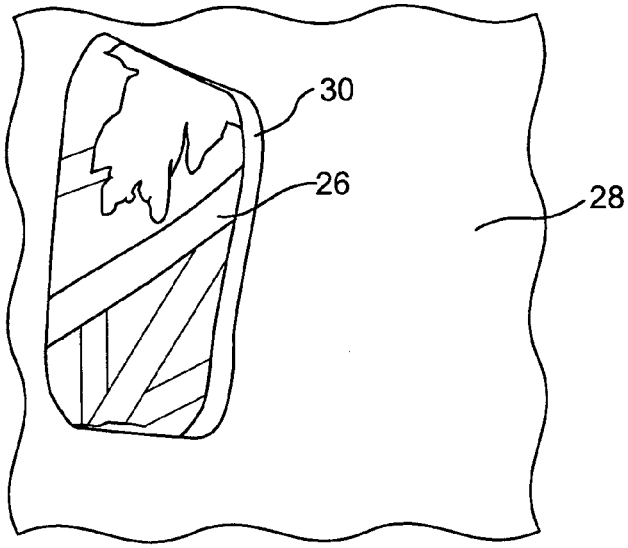
Figure 8:
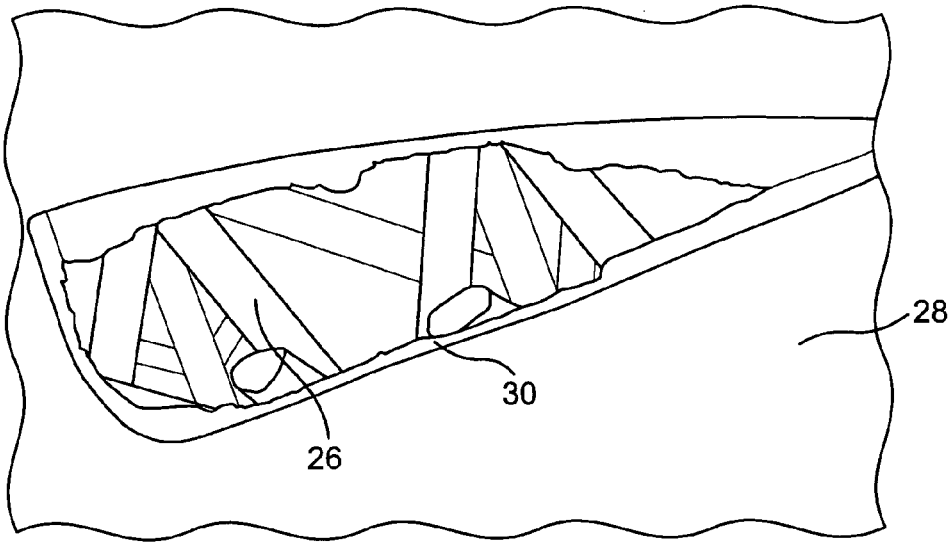

FIG. 5 shows a prototype blade 10 manufactured according to the present invention. Several sand removal pockets 30 are included on surface skin 28. The internal LBM lattice 26 can be more easily seen in the enlarged detail views of the sand removal pockets 30 shown in FIGS. 6–8.

A unitary monoblock propeller can also be manufactured according to the method above. The method can also be used to manufacture other components, including inter alia, any type of aerodynamic blade used to move a fluid material, or be moved by a fluid material, e.g., aircraft propellers, turbine blades, fan blades and windmill blades, as well as other moving structures requiring a lighter structure and specific external shape.

The present invention thus provides a cast propeller, propeller blade or other component that is substantially hollow and weighs substantially less than a corresponding solid component, but which retains a desired strength due to the internal reinforcing of the LBM lattice 26. Such a propeller reduces the stresses imparted on the blade attachment components, main shaft and main shaft bearings that must support the weight of the propeller. The size of the propeller can be increased for better performance without exerting excessive forces on the blade attachment components, main shaft and main shaft bearings. Alternatively, the size and mechanical properties of the blade attachment components, main shaft and main shaft bearings can be reduced since they are exposed to lower forces due to weight of the propeller, thereby reducing the weight of the propulsion system as a whole.

Since the weight of the propeller is lower, fewer compromises in the shape and configuration of the propeller need be made toward propeller weight reduction. This allows the shape and configuration of the propeller blades to be designed for optimal performance with respect to cavitation, modal/vibrational characteristics and other characteristics with fewer limitations imposed by weight considerations. The present invention allows for an expansion in the rake and skew design envelope of the propeller due to the lower weight, thereby reducing mechanical stresses created by centrifugal motion. Since the maximum section thickness of material is reduced in the propeller of the present invention, an improved microstructure and therefore, mechanical properties of the material can be obtained.

In addition, a propeller of the present invention has unlimited tuning options with respect to modal/vibrational characteristics, as compared to solid propellers. Since the propeller of the present invention is substantially hollow, this hollow interior can be filled with various materials to alter the modal/vibrational characteristics of the propeller, as desired. For instance, the hollow interior of the propeller can be filled with light weight resins to dampen vibrations without significantly increasing weight of the propeller. The resins can have uniform density or different resins or materials having different densities or other characteristics can be placed at different positions within the hollow areas to specifically tune the propeller. The hollow areas can be completely filled with resins or only partially filled in certain areas to provide a desired tuning. The tuning can also be obtained by altering the volume of the material in the LBM lattice structure, either uniformly or nonuniformly across a section. The size and positioning of reinforcing spars and sand removal/balancing pockets can be altered to tune the propeller. The internal lattice also allows balancing of the propeller over a much greater area without compromising performance and minimizing the amount of additional weight that must be added or removed.

In an alternative embodiment of the invention, the configuration of the casting cores can be altered to provide varied lattice spar density in certain areas and/or reduced spar density in other areas. For instance, in an area of the propeller where the mechanical stresses are higher, the lattice spar density can be increased to provide additional strength while in lower stress areas, the lattice spar density is reduced to reduce weight. The lattice spar density, alignment and or configuration can also be altered uniformly or nonuniformly in the propeller to alter the modal/vibrational characteristics of the propeller.

In one embodiment of the present invention, the desired lattice spar density, configuration and alignment within the propeller, whether uniform or not can be determined by a selected analysis method, such as finite element analysis. This information can then be input into a CAD/CAM system and transformed to create a plurality of molds for creating a plurality of individual casting cores that when assembled together, will provide a casting core block that will produce a lattice structure having the desired specific spar density, configuration and alignment A numerically controlled cutting machine can be programmed and used to carve the casting core block to the desired configuration prior to casting.

It is intended that various aspects of the various embodiments discussed herein can be combined in different manners to create new embodiments and that various modifications can be made without departing from the scope of the invention.

What is claimed is:

1. An aerodynamic blade, comprising:

an internal lattice support structure having a plurality of interconnected support spars arranged in a 3-dimensional lattice array extending between a pressure side and a suction side of the blade, with interstitial spaces between the support spars being generally hollow;

a surface skin attached to the lattice support structure, the surface skin shaped in a desired aerodynamic form: there being an interstitial hollow space between a pressure side surface skin and a majority of the support spars of the 3-dimensional lattice array, there also being an interstitial hollow space between a pressure side surface skin and a majority of the support spars of the 3-dimensional lattice array.

2. An aerodynamic blade as in claim 1, wherein the internal lattice support structure is a cast LBM lattice.

3. An aerodynamic blade as in claim 2, and further comprising:

a generally solid outer periphery connected to the lattice support structure, the outer periphery generally forming at least one of a leading edge, a trailing edge and a tip of the blade.

4. An aerodynamic blade as in claim 3, and further comprising:

at least one reinforcing spar connected between opposing portions of the outer periphery.

5. An aerodynamic blade as in claim 4, wherein a support spar density of the lattice support structure is greater in a first portion of the blade than in a second portion of the blade.

6. An aerodynamic blade as in claim 4, wherein at least one of a density, alignment and configuration of the support spars of the lattice support structure is set to provide specific modal/vibrational characteristics of the blade.

7. An aerodynamic blade as in claim 6, wherein at least one of the density, alignment and configuration of the support spars of the lattice support structure is nonuniform in different portions of the blade.

8. An aerodynamic blade as in claim 4, and further comprising:

a first fill material added to an interior of the blade to fill a portion of the hollow portion of the lattice support structure.

9. An aerodynamic blade as in claim 8, wherein the fill material alters modal/vibrational characteristics of the blade.

10. An aerodynamic blade as in claim 9, and further comprising:

a second fill material having at least one of a different density and composition than the first fill material added to the interior of the blade to fill a second portion of the hollow portion of the lattice support structure.

11. An aerodynamic blade as in claim 8, wherein the fill material forms at least a portion of the surface skin of the blade.

12. An aerodynamic blade as in claim 2, wherein the surface skin is cast integrally with the lattice support structure.

13. An aerodynamic blade as in claim 12, wherein the surface skin covers substantially all of a surface of the blade.

14. An aerodynamic blade as in claim 1, wherein at least a portion of the surface skin is formed by a fill material attached to the lattice support structure and which at least partially fills a portion of the hollow portion of the lattice support structure.

15. A propeller, comprising:

a hub for mounting to a driven/driving shaft; and a first plurality of aerodynamic blades attached to the hub, each of the first plurality of aerodynamic blades comprising:

an internal lattice support structure having a plurality of interconnected support spars arranged in a 3-dimensional lattice array extending between a pressure side and a suction side of the blade, with interstitial spaces between the support spars being generally hollow;

a surface skin attached to the lattice support structure, the surface skin shaped in a desired aerodynamic form; there being an interstitial hollow space between a pressure side surface skin and a majority of the support spars of the 3-dimensional lattice array, there also being an interstitial hollow space between a pressure side surface skin and a majority of the support spars of the 3-dimensional lattice array.

16. A propeller as in claim 15, wherein the internal lattice support structure is a cast LBM lattice.

17. A propeller as in claim 16, and further comprising:

a generally solid outer periphery connected to the lattice support structure, the outer periphery generally forming at least one of a leading edge, a trailing edge and a tip of the blade.

18. A propeller as in claim 17, and further comprising:

at least one reinforcing spar connected between opposing portions of the outer periphery.

19. A propeller as in claim 18, wherein a support spar density of the lattice support structure is greater in a first portion of the blade than in a second portion of the blade.

20. A propeller as in claim 18, wherein at least one of a density, alignment and configuration of the support spars of the lattice support structure is set to provide specific modal/vibrational characteristics of the blade.

21. A propeller as in claim 20, wherein at least one of the density, alignment and configuration of the support spars of the lattice support structure is nonuniform in different portions of the blade.

22. A propeller as in claim 18, and further comprising:

a first fill material added to an interior of the blade to fill a portion of the hollow portion of the lattice support structure.

23. A propeller as in claim 22, wherein the fill material alters modal/vibrational characteristics of the blade.

24. A propeller as in claim 23, and further comprising:

a second fill material having at least one of a different density and composition than the first fill material added to the interior of the blade to fill a second portion of the hollow portion of the lattice support structure.

25. A propeller as in claim 22, wherein the fill material forms at least a portion of the surface skin of the blade.

26. A propeller as in claim 16, wherein the surface skin is cast integrally with the lattice support structure.

27. A propeller as in claim 26, wherein the surface skin covers substantially all of a surface of the blade.

28. A propeller as in claim 15, wherein at least a portion of the surface skin is formed by a fill material attached to the lattice support structure and which at least partially fills a portion of the hollow portion of the lattice support structure.

29. A propeller as in claim 15, wherein the 3-dimensional lattice array has a uniform and repeating pattern.

30. An aerodynamic blade as in claim 1, wherein the 3-dimensional lattice array has a uniform and repeating pattern.

* * * * *